US005697169A

United States Patent [19]

Jacob

[11] Patent Number: 5,697,169

[45] Date of Patent: Dec. 16, 1997

[54] APPARATUS FOR COOLING STRIP AND ASSOCIATED METHOD

[75] Inventor: William L. Jacob, Pittsburgh, Pa.

[73] Assignee: Busch Co., Pittsburgh, Pa.

[21] Appl. No.: 748,137

[22] Filed: Nov. 12, 1996

[51] Int. Cl.[6] ..... F26B 7/00

[52] U.S. Cl. ..... 34/393; 34/430; 34/614; 34/230; 34/232; 134/64 R; 134/122; 134/199

[58] Field of Search ..... 34/393, 430, 508, 34/516, 60, 62, 614, 230, 232; 134/64 R, 122 R, 199, 102.3; 239/8, 418, 421, 423, 424, 429

[56] References Cited

U.S. PATENT DOCUMENTS

| | | | |
|---|---|---|---|
| 4,076,222 | 2/1978 | Schaming | 266/111 |
| 4,120,455 | 10/1978 | Wilmotte et al. | 239/429 |
| 4,226,108 | 10/1980 | Wilmotte et al. | 72/201 |
| 4,580,353 | 4/1986 | Jalil et al. | 34/430 X |
| 4,688,724 | 8/1987 | Pal et al. | 239/423 X |
| 5,115,972 | 5/1992 | Maier et al. | 239/8 |
| 5,201,132 | 4/1993 | Jacob | 34/13 |
| 5,275,849 | 1/1994 | Castelli et al. | 34/508 X |
| 5,390,900 | 2/1995 | Ginzburg | 266/113 |

*Primary Examiner*—Henry A. Bennett
*Assistant Examiner*—Steve Gravini
*Attorney, Agent, or Firm*—Arnold B. Silverman; Eckert Seamans Cherin & Mellott, LLC

[57] ABSTRACT

Apparatus for cooling strip includes a path of travel for the strip and cooling apparatus having a plurality of elongated gas nozzles within which are disposed water nozzles such that the water nozzles will have a discharge outlet within the gas nozzles and discharge water in generally the same direction as said gas discharge. In a preferred embodiment, the gas enshrouds the water and establishes a cocurrent two-fluid stream which impinges upon the strip moving by the cooling apparatus. Subsequently, heat transfer is enhanced by the air and water dynamics which are provided after impingement by fluid flow fields. The gas nozzles and water nozzles may be coaxial and in one embodiment are each circular. In one embodiment, containment gas is caused to impinge on the strip at a position longitudinally displaced from the regions of impingement of the cocurrent two-fluid stream on the strip so as to resist undesired flow of water. A preferred use of the cooling system of the present invention is in connection with metal strips, such as galvanized metal strips. Associated methods are also disclosed.

52 Claims, 7 Drawing Sheets

APPARATUS FOR COOLING STRIP AND ASSOCIATED METHOD

BACKGROUND OF THE INVENTION

1. Field of the Invention

The present invention relates to the cooling of strips, such as metal strip, which moves through a cooling zone and is cooled by water entrained in gas which impinges upon the strip and to a related method.

2. Description of the Prior Art

It has long been known that for many purposes a combination of materials may provide an advantageous blend of properties for a given product. Among such combinations are the coating of steel strip with a relatively thin layer of zinc in a galvanizing process.

In respect of continuous galvanizing, a steel coil provides a continuous steel strip which is immersed in a molten bath of zinc, is passed through a furnace and is subsequently cooled prior to recoiling. Various types of cooling means for such systems have been known. See, generally, Metal Producing, July, 1990, pages 33, 53.

It has been known in the galvanizing art to employ elongated rigid cooling tubes having longitudinal slots therein. Such tubes are positioned relatively close to the strip being cooled, e.g., on the order of about 5 inches. A number of problems have arisen from such constructions. More specifically, the close proximity of the slots to the strip has resulted in inefficient air flow as the spent gas which has already had contact with the strip surface tends to be reentrained or interfere with efficient flow of the cooling gas from the slots to the strip surface. Also, occasionally either the strip or the slotted tube was damaged as a result of undesired contact therebetween.

A general disclosure of the use of plates with orifices or jet tubes in heating, cooling or drying of various industrial products is contained in Jet Impingement Heat Transfer From Jet Tubes in Orifices, National Heat Transfer Conference, 1989, HTD-Vol. 107, pages 43–50. While not specifically directed toward the cooling of metal strip, the concept of multiple jets for impinging air on a plate and exhausting such air is discussed.

My prior U.S. Pat. No. 5,201,132 discloses a system and an associated method for cooling, heating, wiping or drying strip, such as metal strip. The disclosure of this patent is incorporated herein by reference. It provides the use of a single unit or a pair of units having a source of gas, a plenum, and a plurality of fixed nozzles which are adapted to direct gas onto a passing strip.

U.S. Pat. No. 4,076,222 discloses the use of a solid curtain of water to cool metal strip stock emerging from a rolling mill.

U.S. Pat. No. 5,390,900 discloses a system wherein a curtain of water is employed to cool a metal strip with air used intermittently to divert the water from cooling impingement on the strip.

U.S. Pat. No. 4,120,455 discloses cooling apparatus for cooling metal sections through the spraying of a mixture of gas and liquid. This prior art system provides an air inlet opening, a water inlet opening in communication with the air inlet opening, and an outlet opening. Water droplets generated moves generally radially into the axial air flow.

U.S. Pat. No. 4,226,108 discloses the use of two hollow caissons, one inside the other, with sprayers adapted to effect atomizing of the water by the air.

My co-pending application Ser. No. 08/259,750, filed Jun. 10, 1994, discloses a method and apparatus for treatment of strip which in some embodiments employ flexible nozzles and/or units impinging treatment gas on both sides of the metal workpiece.

In spite of the contributions made by this prior art, there remains a need for improved efficiency cooling of metal strips.

SUMMARY OF THE INVENTION

This invention has provided improved cooling of strip by means of apparatus and associated methods wherein the cooling system of the present invention is placed adjacent to the path of travel for the strip. The cooling means has a plurality of elongated gas nozzles projecting generally in the direction of the path of strip travel with gas supply means for supplying cooling gas to the gas nozzles and establishing gas flow therethrough. Elongated water nozzles are disposed within the elongated gas nozzles for discharge of water therefrom and are associated with water supply means for delivering water to the nozzles. The water nozzles have an outlet end facing the outlet of the gas nozzle within which it is disposed. Water emerging from the nozzles will move generally in the same direction as gas emerging from the gas nozzle. The water nozzle outlet ends are preferably spaced inwardly from the gas outlet ends to thereby permit the gas to enshroud the water. The gas nozzles are preferably positioned in a plurality of rows with alternate rows having the nozzles in relative staggered position with respect to nozzles in adjacent rows.

In one embodiment, a first unit having a plurality of elongated gas nozzles containing water nozzles is disposed on one side of the path of strip travel and a second unit having a plurality of elongated gas nozzles containing water nozzles are disposed on the other side of the path of travel.

Certain preferred relative lengths of the gas nozzles and water nozzles, relative flow rates in each of them, relative sizes of the gas nozzles and water nozzles, and the distance between the water nozzle outlet and gas nozzle outlet are disclosed.

A second gas supply source which is employed for water containment is employed to resist undesired flow of water along the strip being cooled. Certain preferred relative positions with respect to the gas nozzles and water nozzles contained therein and the water containment gas supply means are disclosed.

In one preferred embodiment, the elongated gas nozzles and elongated water nozzles are generally circular and coaxial with the water nozzles having a lesser axial extent.

It is an object of the present invention to provide apparatus and an associated method for effecting cooling of a strip, such as a metal strip, by means of a cocurrent two-fluid stream established by providing a water nozzle having a discharge outlet terminating within a gas nozzle.

It is another object of the present invention to provide such a system wherein independent control of the rate of water flow and the rate of gas flow are provided.

It is a further object of the present invention to provide such a system wherein a cooling cocurrent two-fluid stream is created within the gas nozzles and is caused to impinge upon the moving strip and simultaneously an independent gas flow resists undesired water flow along the surface of the strip being cooled.

It is a further object of the present invention to affect a higher rate of cooling through the combined use of gas and water.

It is another object of the present invention to provide such a system wherein both the gas and water move at a high velocity under low pressure.

It is a further object of the present invention to provide such a system wherein the water emerging from the water nozzles is shrouded in the gas.

It is a further object of the present invention to provide such a system which may be retrofit into existing systems producing metal strips of various types, such as galvanizing lines.

It is a further object of the present invention to provide such a system which may be employed to accommodate a wide variety of heat transfer conditions.

It is another object of the present invention to provide such a system wherein interactions between gas flow and water flowing therein enhance heat transfer when the two-fluid stream flows over a hot strip.

These and other objects of the invention will be more fully understood from the following detailed description of the invention on reference to the illustrations appended hereto.

BRIEF DESCRIPTION OF THE DRAWINGS

FIG. 4(*b*) is a partially schematic view of the apparatus of FIG. 4(*b*) showing both cooling units and the exhaust system.

DESCRIPTION OF THE PREFERRED EMBODIMENTS

As employed herein, the term "cocurrent two-fluid stream" means a combination of gas and water created by the introduction of water by means of an elongated nozzle which is either coaxial with or has an axis which is generally parallel to an elongated gas nozzle with the outlet of the water nozzle terminating short of or being coextensive with the outlet end of the gas nozzle such that the water will initially be enshrouded within the gas and prior to impingement on the strip will have the water in a stream or smaller particles dispersed through the gas. For certain uses, it may be desired to provide additives to water or to substitute another liquid for water, such as, for example, the use of another liquid in cooling aluminum strip. Such other liquids shall be deemed to be embraced within the term "water" as employed herein.

Figure 1:
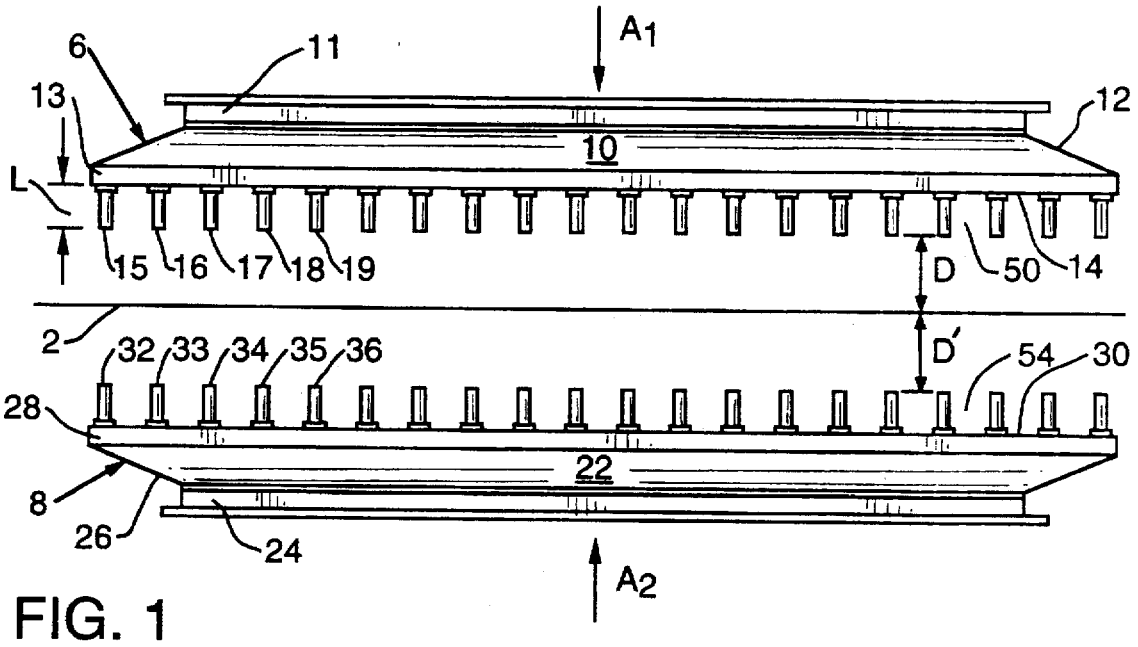
FIG. 1 is a partial front elevational view of a form of apparatus of the present invention having generally horizontal strip movement.
Figure 2:
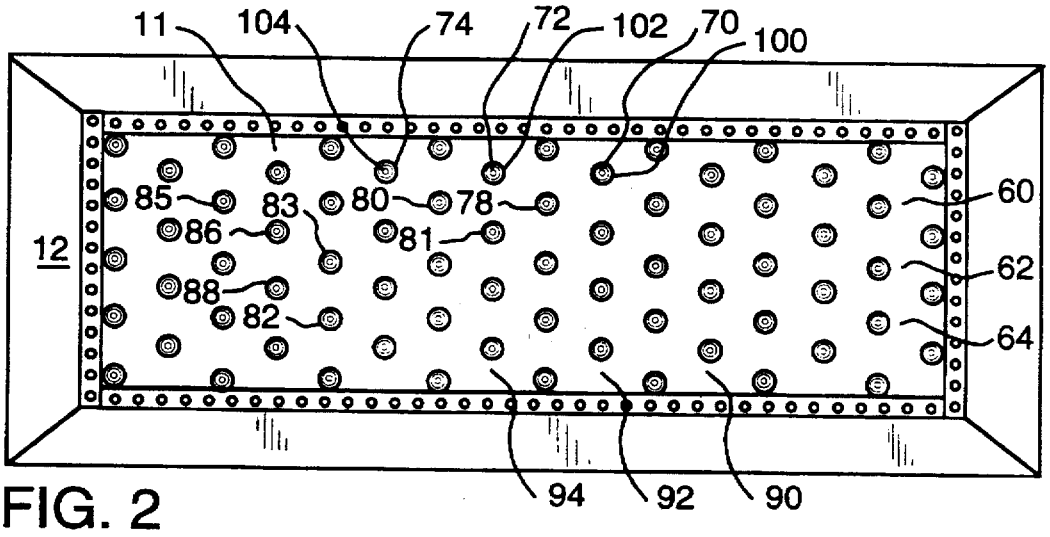
FIG. 2 is a partial top plan view of the lower unit of the apparatus shown in FIG. 1.
Figure 3:
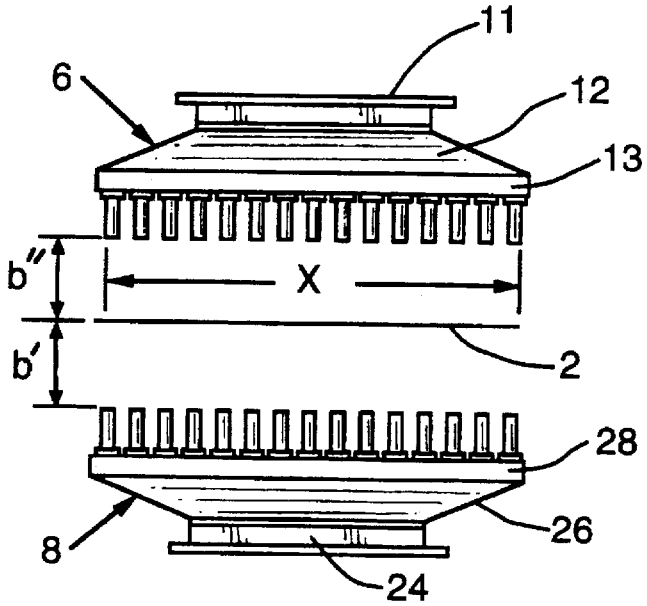
FIG. 3 is a right-side elevational view of the apparatus of FIG. 1.

Referring now more specifically to FIGS. 1 through 3, there is shown a preferred embodiment of the apparatus. In general, it is conventional after immersing steel strip in zinc to have the strip travel vertically through an annealing furnace and then be transported vertically and horizontally through a cooling zone.

In the form shown, the galvanized steel strip 2 is traveling in a linear path which may be from left to right, as shown in FIG. 1, between first cooling unit 6 and second cooling unit 8. The first cooling unit 6 has a hollow body portion or plenum 10 which is open upwardly and is adapted to cooperate with means, such as a fan for establishing the flow of the cooling gas, such as air in the direction indicated by arrow A. The plenum 10 has a throat 11 which defines a gas receiving opening, a diverging transition wall 12, a sidewall 13 and a front wall 14. In the alternative, a box type entry without the diverging portion 12 or any other desired plenum shape could be employed.

The means for establishing gas flow will generally be a fan which may be directly secured to the upper portion of plenum 10 or may be connected thereto by appropriate ductwork (not shown). The former approach provides the benefit of eliminating the need for ductwork. The latter approach permits insertion in the duct of gas temperature altering means, such as cooling or heating units, if desired. All that is required is that a portion of the upward opening of the plenum 10 be closed off as by a suitable sheet metal section and that a fan suitably sized in accordance with procedures well known to those skilled in the art be secured thereto. Disposed under the plenum 10 and in communication therewith are a plurality of elongated downwardly projecting nozzles, a sampling of which has been numbered 15 through 19. Gas to be delivered through the nozzles enter plenum 10 in the direction indicated by arrow $A_1$. These nozzles 15–19 are preferably tubular and have a generally circular configuration with an internal diameter of about 1 inch to 4 inches and preferably about 1½ to 2½ inches. The nozzles preferably have a length L of about 3 to 15 inches and preferably about 5 to 12 inches. The nozzles have an upper end secured to and communicating with the plenum 10 and a lower discharge end which is spaced a distance D from the upper surface of the strip 2.

Second cooling unit 8 has a plurality of elongated upwardly projecting nozzles, a sampling of which has been numbered 32 through 36. Gas to be delivered through the nozzles of unit 8 enters plenum 22 in the direction indicated by arrow $A_2$. A distance D' which is preferably equal to distance D exists between the free ends of the nozzles of cooling unit 8 and the strip 2. The spacing D, $D^1$ (FIG. 1) or b', b" (FIG. 3) between the strip and the free end of the nozzles is preferably about 3 to 7 times the nozzle internal diameter.

Plenum 22 has a throat 24, a diverging transition wall 26, a sidewall 28, and a front wall 30. The plenum 22 is operatively associated with the upwardly projecting elongated nozzles, such as 32–36, for example. In the preferred embodiment, the second cooling unit 22 will have generally the same number of nozzles of the same shape and size as the first cooling unit 6.

It will be appreciated that cooling gas, which may be air and water in the form of a water mist emerging from the nozzles of the two cooling units 6,8 will impinge upon opposite sides of the strip 2 to effect cooling from both sides. There may be instances where it is not desired or not practical to have both sides of the strip be impinged on by water mist issuing from extended nozzles for the purpose of cooling. In those cases only one side would be impinged on, resulting in less overall heat transfer per unit area; however, what heat transfer there is can be most optimum for conditions. There are also conditions which affect strip stability and vibration where the impingement on the opposite sides of the strip will differ in gas velocity and/or volume.

It will be appreciated that while FIGS. 1 through 3 illustrate a single pair of units, in general, installations will have a plurality of such pairs of units disposed along the path of strip travel with the pairs being in relative generally aligned relationship with respect to other pairs.

The cooling gas and water will preferably be at an ambient temperature unless that is objectionable for personnel health and safety due to climatic conditions.

It is desired to provide a high coefficient of thermal transfer between the gases and the surfaces of strip 2. This is preferably accomplished by employing a relatively low volume, high velocity delivery of the gas from the nozzles to the strip 2. In one embodiment, the velocity of the cooling gas, which may be at ambient temperature, is about 1,000 to 13,000 feet per minute and preferably about 8,000 to 13,000 feet per minute with each unit having about 100 to 250 nozzle members. For example, a velocity of about 10,000 feet per minute producing a volume of air at 218 cubic feet per minute with 2 inch internal diameter nozzles may be employed. These ranges provide good heat transfer, energy efficiency and maintenance of strip stability, by resisting aerodynamically induced strip vibrations.

It will be appreciated that the water mist emerging from the nozzles will provide efficient heat transfer on the strip by establishing a thin boundary layer of water mist as the water mist impinges on the strip with subsequent turbulent interactive mixing when flow of the boundary layers created by each nozzle collides with similar flow from other nozzles.

In the preferred practice of the present invention, the spaces between the exteriors of the nozzles on first cooling unit 6 (which space shall generally be designated 50) provide a region between the free ends of the nozzles and the front surface 14 of the plenum 10 which will serve to facilitate exhaust of spent water mist. This results in efficient flow of the cooling water mist emerging from the nozzles over the full surface of the metal strip 2. The spent water mist will move through zone 50 and outwardly to be exhausted. Similarly, zone 54 of the second cooling unit 8 cooperates with surface 30 to provide for exhaust in the corresponding region. By providing this efficient flow path from nozzle to strip 2 to exhaust in combination with other preferred features of the present invention a high coefficient of thermal transfer is obtained.

In the use of the system of this invention in cooling strip, the flow of spent water mist over the exterior of the nozzles in spaces 50,54 and over the surfaces 14,30 of plenums 10,22, respectively, serves to withdraw heat created in these portions of the system due to heat radiating from the hot strip.

Referring to FIG. 2, the strip is traveling from right to left. In a preferred embodiment, the nozzles are contained within a plurality of columns, such as column 60, column 62, and column 64. In the preferred practice of the invention, the nozzles of one row, such as nozzles 70,72,74 of column 60, will be in staggered relationship with respect to the nozzles of the next adjacent column, such as nozzles 78,80 and 82 of column 62. This facilitates obtaining more uniform coverage of the strip by the cooling water. Similarly, with respect to vertical rows, such as 90,92,94, nozzles in adjacent rows are also preferably staggered. In the most preferred embodiment, a gas nozzle from one column, such as 88, and the two closest gas nozzles 82,83 from an adjacent column, will form an equilateral triangle.

In a manner to be described hereinafter, each said gas nozzle will contain a water nozzle, such as nozzles 100,102, 104, for example, respectively, disposed within gas nozzles 70,72,74.

While the system may employ any desired number of nozzles and the number used will depend in part upon the internal diameter selected for the nozzle elements, it will generally be preferable to have the gas nozzle positioned at a center-to-center spacing within a column of 4 to 6 times the gas nozzle internal diameter.

The strip will generally have a thickness of about 0.012 to 0.375 inch and about 0.02 to 0.10 inch being common and a thickness of about 0.045 inch is about average, although these dimensions are not limiting of the invention. The strip travel may be about 250 to 600 feet per minute within the zone.

The strip may have a width on the order of about 24 to 72 inches which maximum dimension is indicated by the dimension X in FIG. 3. Where strips of lesser width are employed, while not essential, it may be desirable as to those nozzle elements which are disposed transversely outwardly of the strip and thereby directly confronting each other without the strip 2 serving as a barrier, to provide either a barrier or through inserts in the nozzles or other means reduce or terminate the flow output of those nozzles so as to minimize the likelihood of creating undesired vibrations and noise within the strip 2.

Figure 4A:
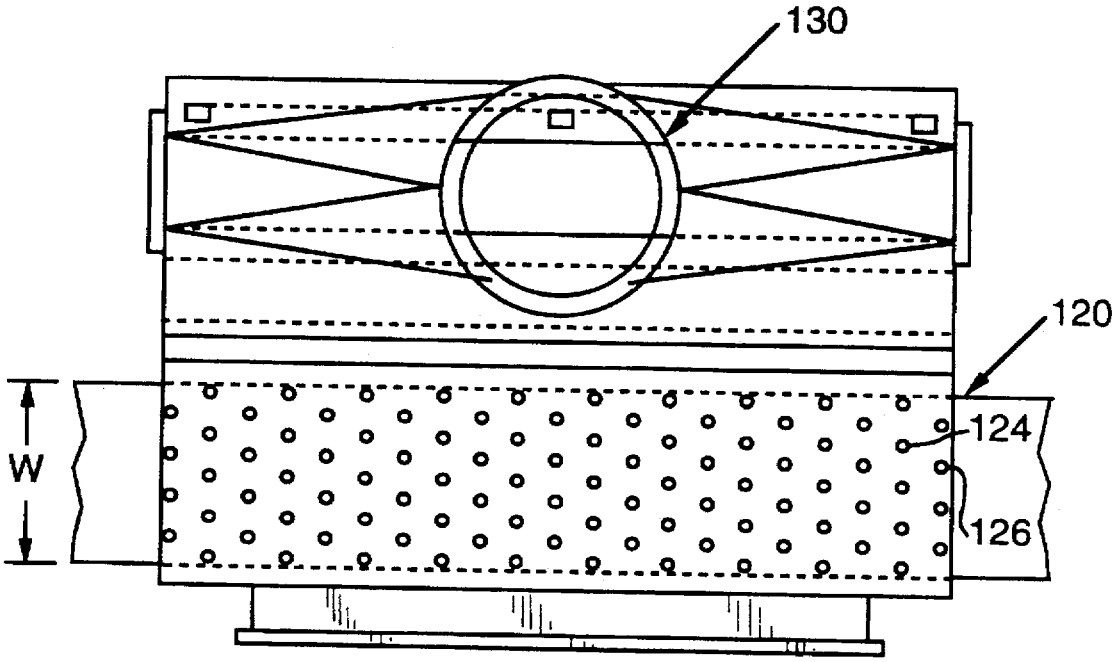
FIG. 4(*a*) is a partially schematic top plan view showing a portion of the apparatus of the present invention.
Figure 4B:
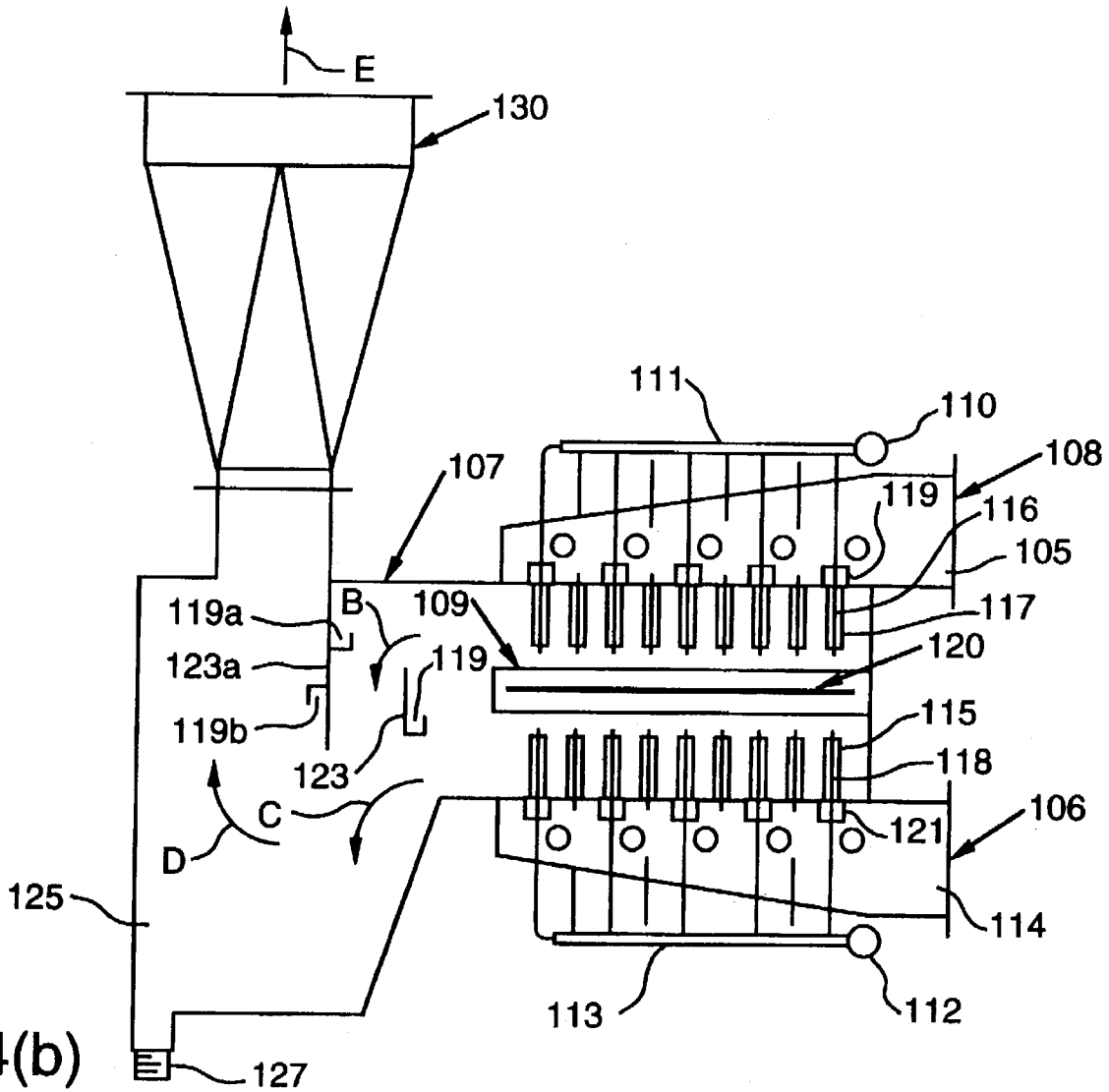

Referring to FIGS. 4(*a*) and 4(*b*), there is shown a strip 120, a portion of which passes over a plurality of gas nozzles 124,126, for example, each of which contains a water nozzle (not shown). In this embodiment, the spent gas and vapor are exhausted from the regions between the strip 120 and the gas nozzles are exhausted through exhaust conduit 130. FIG. 4(*a*) shows two cooling units 106 which have, respectively, supply means 110,112 and associated headers 111,113 for supplying water to the water nozzles, such as 116,118, which are disposed within gas nozzles 115,117. Stabilizers 119,121 support the water nozzles 116,118, respectively. Gas supply is provided through plenums 105,114. The spent gas and water after cooling the strip along with the gas, such as air used for containment (as hereinafter described) is confined between the strip (which has its entry and exit through conventional aerodynamic seals, such as seal 109) (FIG. 4(*b*) and the regions between gas nozzles. Under (a) the influence of an exhaust fan (not shown) which may be positioned in exhaust conduit 130 or (b) the gas and water pressure, or (c) both, the two-phase fluid flows to the left in FIG. 4(*b*) in duct 107. The gas, which is preferably air, travels in the path indicated by arrows B, C, D out of exhaust conduit 130 as shown by arrow E. Water droplets travel in the direction shown by arrows B, C after at least a portion is removed from duct 107 by baffles 119, 119*a* and gutters 123, 123*a* (shown schematically) and out through water drain 127. The gas and water may be disposed of or reused with or without intermediate processing, as desired.

Referring still to FIGS. 4(*a*) and 4(*b*), it will be appreciated that the strip 120 has a width W and that the nozzles, such as 124,126, in the aggregate, provide coverage for the full width W of the strip.

Figure 5:
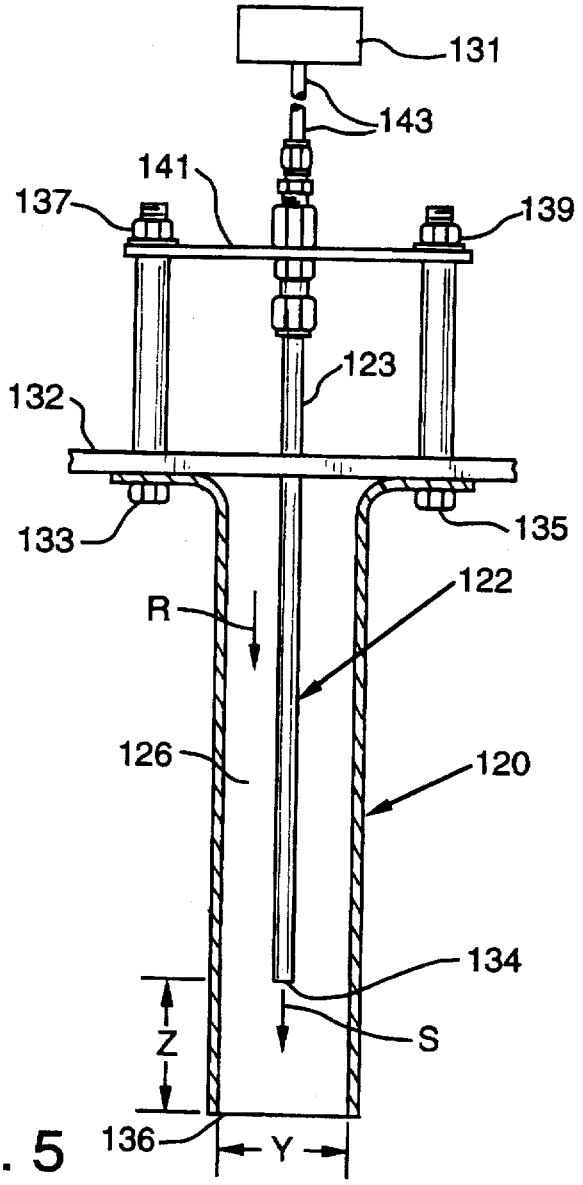
FIG. 5 is a partially schematic, partially cross-sectional detail showing the relationship between an elongated water nozzle and elongated gas nozzle.
Figure 6:
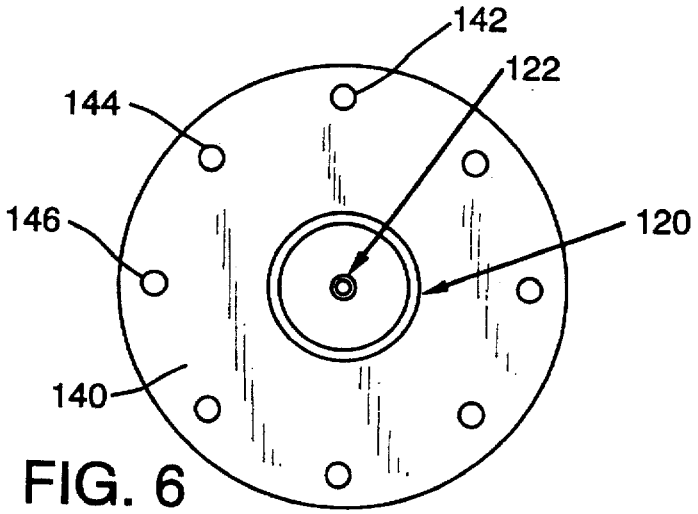
FIG. 6 is a front elevational view of a form of nozzle assembly.

Referring to FIGS. 5 and 6, greater detail regarding the use of elongated gas nozzles 120 and elongated water nozzles 122 in combination will be considered. Gas nozzle 120 is secured to the plenum wall 132 by bolts 133,135 (shown within spacers) and cooperating nuts 137,139 with plate 141 serving to secure water supply pipe 143 which receives water from water supply means 131. The plate may, for example, be rectangular, circular or spider-like with three or four bolts employed.

The subunit shown in FIGS. 5 and 6 represents a single nozzle combination of the type which will be reproduced in order to provide the plurality of gas nozzles and associated water nozzles provided in the cooling system. The elongated gas nozzles 120 in the form shown are such that they are coaxial with the water nozzle 122. Each nozzle is preferably generally circular although other arrangements may be employed. It is preferred that the outer circumference of the elongated water nozzle 122 not be in contact with the inner surface of gas nozzle 120. In a preferred embodiment of the invention, the elongated gas nozzle 120, which is substantially straight, will receive a supply of gas, such as air, as in the form shown in FIGS. 1 through 3, moving in the direction of arrow R within the annulus 126 between the outer surface of elongated generally straight water nozzle 122 and the inner surface of gas nozzle 120. Water is supplied to the discharge end 134 of the elongated water nozzle 122 and will be axially spaced from the discharge end of gas nozzle 120 by a distance Z which is about 0 to 4 inches and preferably about 1.5 to 3.5 inches. Also, the internal diameter of the water nozzle 122 is preferably about ⅛ to 7/16 inch. The internal diameter of the water nozzle 122 is preferably about ⅛ to ⅜ inch and the internal diameter of the gas nozzle is preferably about 1 to 3 inches. Water emerging from the elongated water nozzle 122 will travel in the direction indicated by arrow S and, in view of the symmetrical placement and the coaxial relationship between nozzles 120 and 122, the water will be enshrouded by the gas. As the enshrouded water and gas emerge from the discharge end 136 of the gas nozzle 120, the generally circular outer configuration of the resultant water mist will become radially enlarged such that when it impacts with the strip depending upon the respective pressure and velocities of the water stream and gas stream as they emerge from the respective outlets 134,136, the diameter may be about 0.5 to 3 multiples of diameter Y. In general, it will be preferred to have the gas nozzle outlet 136 about 6 to 12 inches from the path of travel of the strip.

It is preferred to employ low pressure in respect of both the water emerging from the water nozzle 122 and gas emerging from gas nozzle 120. The gas velocity may be about 8,000 to 13,000 feet per minute. A preferred velocity for the gas is about 8,000 to 11,500 feet per minute. A preferred flow rate for the water traveling through nozzle 122 is about 0.1 to 4.6 gallons per minute with about 0.2 to 1 gallon per minute being the preferred rate.

As the means for securement of the nozzle 120 and nozzle 122 to the assembly will be well known to those skilled in the art, details need not be provided. One means is shown in FIG. 5. In the form shown, the gas nozzle 120 is secured to a disk 140 which has a plurality of openings, such as 142,144,146, for example, through which mechanical fasteners may pass in order to secure the nozzle 120 to the support framework. Similarly, a spider member (not shown) may have a central opening for receipt of the nozzle 122 or tube 123 and radiating arms terminating in members which may be anchored to the apparatus.

Figure 7:
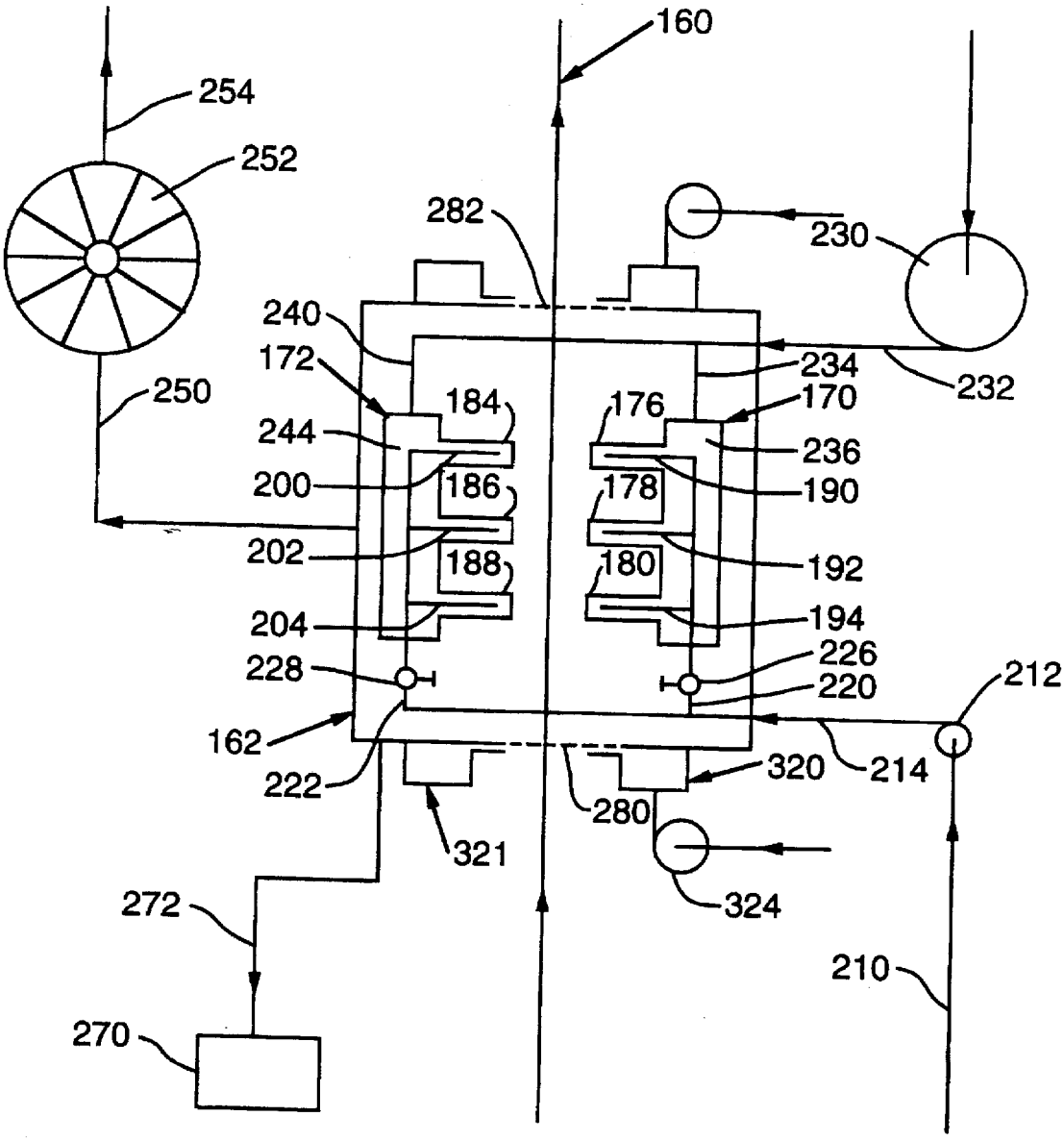
FIG. 7 is a schematic illustration showing a system of the present invention.

Referring to FIG. 7, an overview of a system of the present invention will be considered. In this embodiment, the strip 160 is moving in upwardly in a generally vertical direction. It will be appreciated that the invention is adapted to be used with strip traveling horizontally, vertically or angularly at positions therebetween. A housing 162 contains a first cooling unit 170 and a second cooling unit 172 which have a plurality of gas nozzles 176,178,180 and 184,186,188, respectively, contain elongated water nozzles 190,192,194 and 200,202,204, respectively. In the form shown, a suitable water supply line 210 has a water pump 212 which supplies water to header 214 which, in turn, delivers water to branches 220,222 which respectively have valves 226,228 and are respectively connected with water nozzles 190,192,194 and water nozzles 200,202,204.

The gas nozzles 176,178,180 are supplied with low-pressure, high velocity gas from gas supply means 230 through duct 232 and branch duct 234 to header 236 and to nozzles 184,186,188 through duct 232 and branch duct 240 to header 244. Exhaust is removed from the system by means of duct 250 which is in communication with the interior of housing 162 and has fan 252 which discharges the exhaust to the atmosphere through duct 254. Excess water is returned to the sump 270 in line 272. Appropriate mist containment seals 280,282 are provided respectively at the entrance and exit to the housing.

Figure 8:
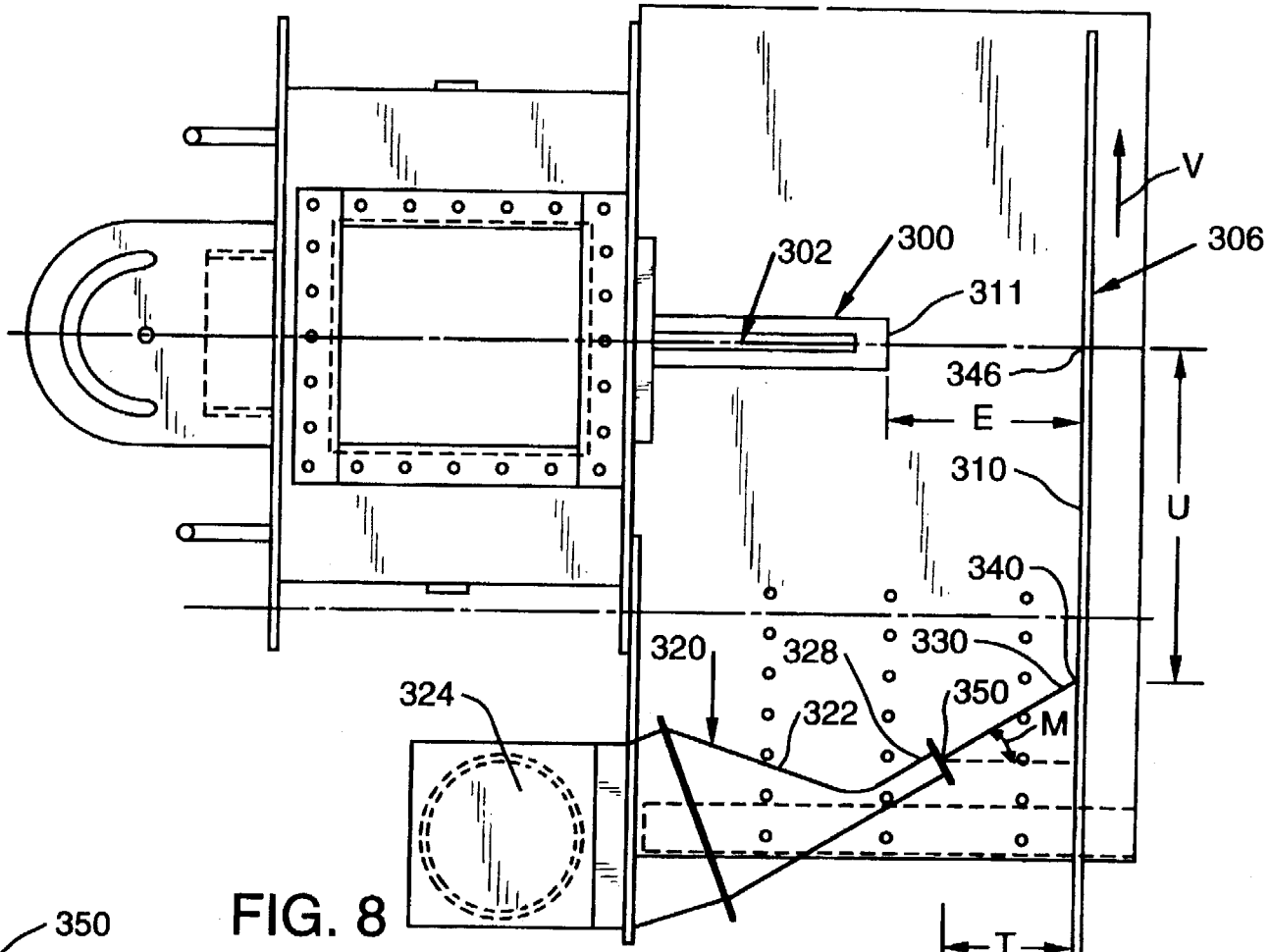
FIG. 8 is a partially schematic illustration showing the containment gas supply means in combination with a portion of the system of the present invention.

Referring to FIG. 8, another embodiment of the invention will be shown. For simplicity of illustration, a single gas nozzle 300 containing a water nozzle 302 is directed toward a strip 306 which is moving vertically in the direction indicated by arrow V. The distance E between the outlet end 311 of gas nozzle 300 and the inner surface 310 of strip 306 is preferably about 6 to 12 inches. It will be appreciated that a cocurrent two-fluid stream impinging on inner surface 310 of strip 306 will have water components which under the influence of gravity and deflected impingement flow tend to flow downwardly. A containment gas unit 320 has a housing 322, a source of gas which may consist of a fan bringing in atmospheric air through a duct 324 in communication with housing 322 and an air containment discharge nozzle 328. It will be appreciated that the gas emerging from the nozzle 328 will follow a path 330 and impinge upon the strip 306 at a point 340 which is longitudinally displaced by a distance U which may be about 2 to 10 inches from the point 346 which is the center of the cocurrent two-fluid stream contact with the inner surface 310 of strip 306. In a preferred embodiment, the angle M between a line perpendicular to the strip 306 and a line along which the gas flow moves will preferably be in the range of about 10 to 30 degrees. The gas traveling along line 330 will physically resist undesired excessive downward flow of the water component of the cocurrent two-fluid stream and will also contribute to evaporation of such water. The containment gas preferably flows at about 200 to 250 feet per second. If desired, this gas may be provided at an elevated temperature in order to enhance evaporation of fugitive water droplets particularly when the strip is cold. It is preferred that the nozzle 328 have a discharge end 350 which is a distance T of about 2 to 8 inches from the inner surface 310 of the strip 306. Two such water control units 320,321 having a suitable fan and duct arrangement are shown in FIG. 7. A preferred approach is to have gas supplied to unit 321 through a duct (not shown) connected to unit 320.

Figure 9:
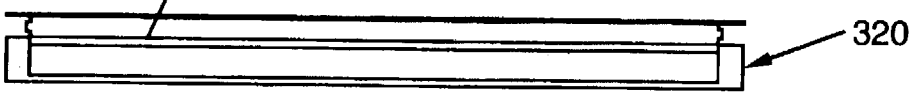
FIG. 9 is a top plan view of the containment gas supply means of FIG. 8.
Figure 10:
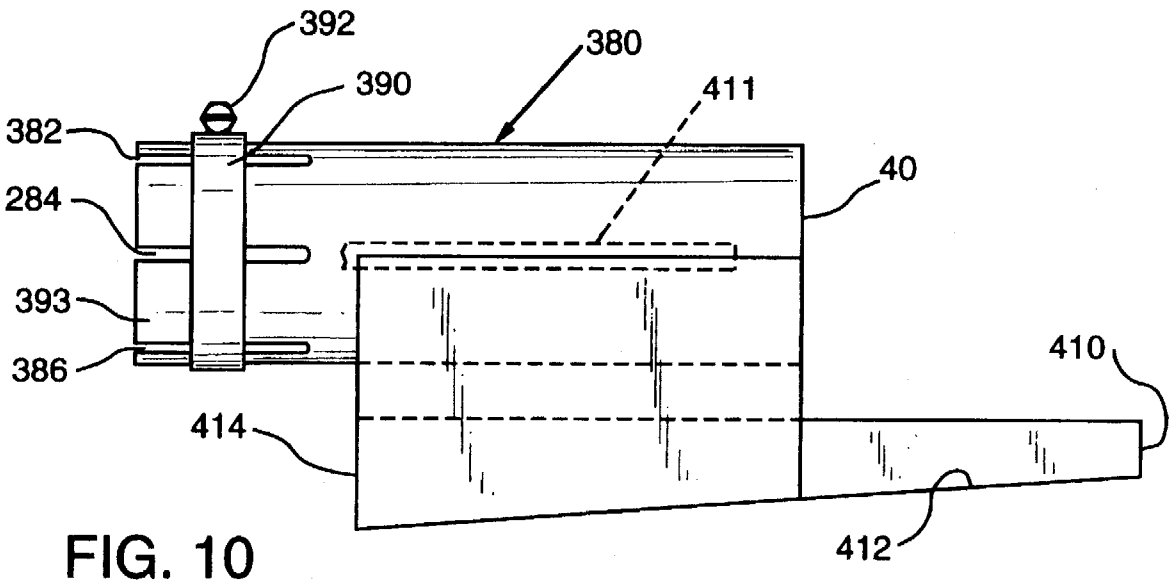
FIG. 10 is a front elevation of a drainage adapter securable to a gas supply nozzle of the present invention.
Figure 11:
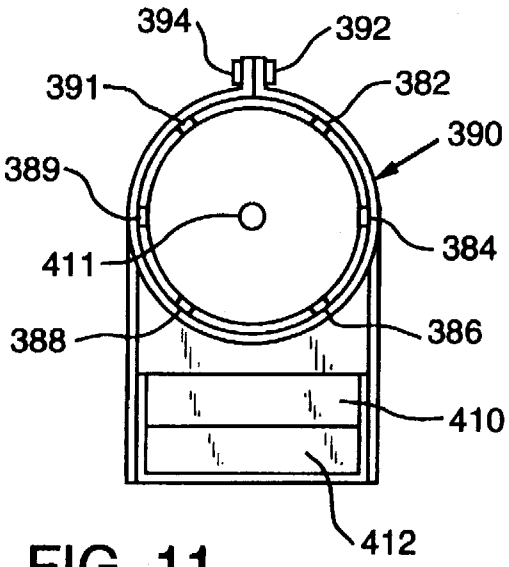
FIG. 11 is a left side elevational view of the drainage adapter of FIG. 10.

As shown in FIG. 9, in a preferred embodiment, the water containment gas system will have an elongated slot 350 which will be at least of the same width as strip 306 to provide substantially continuous water containment gaseous flow.

It will be appreciated that even if the strip is not traveling in a vertical path, but is at an angle between the horizontal and vertical, gravity induced flow and deflected impingement flow of moisture can be controlled using the unit of FIGS. 8 and 9. For example, it also could be employed with horizontal strip movement for removing zinc oxide film produced during galvanizing and molten salt film which results from quenching some grades of steel.

The water film which spreads over the hot strip surface at temperatures below the Leidenfrost temperature in combination with the gas flow produces high heat transfer rates due to enhanced evaporation.

The method of the present invention, therefore, involves providing a plurality of elongated gas nozzles containing elongated water nozzles which have their discharge end terminating short of the discharge end of the gas nozzles with the gas nozzle and water nozzle preferably being coaxial. By controlling the velocity and flow rate respectively of the gas and water, appropriate control of the cocurrent two-fluid stream which will emerge from the gas nozzle and impinge on the strip will be employed. The gas transports the water in a continuous stream or droplets to the hot surface of the strip as a coaxial cocurrent two-fluid stream.

When the cocurrent two-fluid stream, which is preferably coaxial, impinges on the surface of the strip, the gas and water move along the strip to enhance heat transfer, after which, the gas and water partially under the influence of the cocurrent two-fluid stream from adjacent nozzles, will move away from the strip and be exhausted through regions between the projecting nozzles and the cooling unit front faces.

It will be appreciated, therefore, that the unique combination of elongated gas nozzles containing axially shortened water nozzles provides for effective cooling of strip in various orientations by means of a water mist. The structural and functional relationships between the gas nozzle and water nozzle, as well as flow rates therefrom and positioning thereof contribute to the effectiveness of the cooling. A cooling unit may be provided on each side of the strip. Advantageous use of water containment gas flow means is also provided.

The present invention resists undesired consequences of certain system breakdowns. For example, should vertical movement of the strip being cooled be stopped, the water mist will continue to be withdrawn through the exhaust means disclosed hereinbefore after contact with the strip. This serves to resist undesired entry of excessive water into the cooler. Such excessive flow could create a hazardous condition through water flow into a molten zinc pot or into a hot holding furnace under the cooler.

The system may also resist undesired contact between water emerging from the water nozzles when gas flow is terminated either by design or due to system failure. An adapter 380 is structured to be received over the exterior of a gas nozzle. A plurality of elongated slots 382,384,386,388, 389,391 permit the rear portion 393 to expand and contract. The adapter 380 may be positioned over the exterior of the gas nozzle with the forward opening 40 being positioned adjacent to the gas nozzle outlet opening or at other relative positions as desired. This results in desired positioning of lip 410 with respect to gas nozzle opening 40. The clamp 390 is then tightened by bolt 392 and nut 394 to effect at least partial closing of the slots 382,384,386,388,389,391 to thereby secure the adapter 380 to the nozzle. Underlying the opening 40 is a water receiving tray 412 which has a surrounding lip 410 and slopes rearwardly. As water emerging from water nozzle 411 will not be carried by gas when gas flow is terminated, water will flow out of opening 40 and into tray 412 and be carried out of rear opening 414 into an underlying container or drainage system thereby avoiding water impingement on the strip. In the alternative, an interlock could be provided to turn off the water when the gas supply is turned off. If desired, the gas nozzles may slope toward plenum and thereby permit water in the gas nozzles to drain into the plenum.

It will be appreciated that the cooling system of the present invention may be employed advantageously in combination with other cooling units, if desired. For example, an air only cooling system may be employed upstream of the gas/water system of the present invention in order to resist warpage or for other purposes. Also, if desirable, to achieve a particular strip cooling profile, water supply to all or certain water nozzles, such as certain rows, can be reduced or eliminated.

While for purposes of simplicity of illustration herein, reference has been made specifically to use of the system of the apparatus and method of the present invention with galvanized metal strip, it will be appreciated that the invention is not so limited and may be employed in cooling of other types of metal strip.

For example, stainless steel exiting an annealing furnace or aluminum coils, as well as other metals, may be cooled by the practice of the present invention.

Whereas particular embodiments of the invention have been described herein for purposes of illustration, it will be evident to those skilled in the art that numerous variations of the details may be made without departing from the invention as set forth in the appended claims.

I claim:

1. Apparatus for cooling strip comprising a path of travel for said strip, cooling means disposed in relative spaced relationship with respect to said path of strip travel, said cooling means having a plurality of elongated gas nozzles projecting generally in the direction of said path of strip travel and gas supply means for supplying cooling gas to said gas nozzles and establishing flow therethrough, elongated water nozzles disposed within said elongated gas nozzles for discharge of water therefrom, water supply means for delivering water to said water nozzles, and said water nozzles having an outlet end generally facing the outlet ends of the gas nozzles within which it is disposed, whereby water emerging from said water nozzles will be moving in generally the same direction as gas flowing within the gas nozzle within which said water nozzle is disposed.

2. The apparatus of claim 1 including said water nozzle outlet ends being spaced inwardly from or aligned with the gas nozzle outlet ends.

3. The apparatus of claim 2 including said water nozzle outlet ends being spaced inwardly about 0 to 4 inches from the gas nozzle outlet ends.

4. The apparatus of claim 2 including said gas nozzles being positioned in a plurality of columns, and gas nozzles of one said column being in relative staggered position from gas nozzles of an adjacent said row.

5. The apparatus of claim 4 including said elongated gas nozzles being oriented generally perpendicularly with respect to said path of strip travel.

6. The apparatus of claim 1 including said cooling means having a first unit having a said plurality of elongated gas nozzles and water nozzles on one side of said path of strip travel and a second unit having a said plurality of elongated gas nozzles and water nozzles on the other side of said path of strip travel.

7. The apparatus of claim 5 including said gas nozzles being generally circular, and said water nozzles being generally circular.

8. The apparatus of claim 7 including said water nozzles being generally coaxial with the said gas nozzle within which they are disposed.

9. The apparatus of claim 8 including the internal diameter of said water nozzle is about 1/8 to 7/16 inch.

10. The apparatus of claim 8 including said water nozzles having an internal diameter of about 1/8 inch to 3/8 inch.

11. The apparatus of claim 10 including said gas nozzles having an internal diameter of about 1 to 4 inches.

12. The apparatus of claim 8 including the size, axial extent, and relative positions of said gas nozzles and said water nozzles disposed therein, are structured to provide a gas shroud for water emerging from said water nozzles.

13. The apparatus of claim 12 including said gas supply means having means for moving cooling gas out of said gas nozzles at a velocity of about 8000 to 13,000 feet per minute.

14. The apparatus of claim 13 including said water supply means having means for moving water out of said water nozzles at a rate of about 0.1 to 4.6 gallons per minute.

15. The apparatus of claim 12 including said water supply means having means for moving water out of said water nozzles at a rate of about 0.2 to 1 gallon per minute.

16. The apparatus of claim 12 including said gas nozzles, water nozzles, gas supply means, and water supply means cooperating to deliver a cocurrent two-fluid stream to a strip moving in said path of strip travel.

17. The apparatus of claim 2 including water containment gas supply means for resisting undesired flow of water along said strip by delivering gas to said strip at a position longitudinally displaced along said strip from the positions at which water and gas emerging from said gas nozzles impinges on said strip.

18. The apparatus of claim 17 including said water containment gas supply having an elongated slot for discharge of gas across the width of said strip.

19. The apparatus of claim 18 including said water containment gas supply means structured to deliver said gas to said strip at an angle of about 10 to 30 degrees.

20. The apparatus of claim 19 including second gas supply means for supplying gas to said water containment gas supply means.

21. The apparatus of claim 17 including said path of strip travel not being horizontal, and said water containment gas supply means delivering said gas to a said position at a lower elevation than the elevation at which the gas and water emerging from said gas nozzles impinge on said strip and resists downward flow of said water along said strip.

22. The apparatus of claim 21 including said path of strip travel is generally vertical.

23. The apparatus of claim 1 including said apparatus being structured to effect cooling of galvanized metal strip.

24. The apparatus of claim 5 including said gas nozzles having a discharge end disposed about 6 to 12 inches from said path of strip travel.

25. The apparatus of claim 24 including said gas nozzles having a length of about 3 to 15 inches.

26. The apparatus of claim 1 including water flow control means for terminating the flow of water out of selected said water nozzles to permit gas flow without water flow out of the gas nozzles within which said water nozzles have no flow of water are disposed.

27. The apparatus of claim 1 including water flow control means for resisting water flow to said strip when gas flow out of said gas nozzles is terminated.

28. The apparatus of claim 27 including said water flow control means includes an adapter secured to a said gas nozzle, and said adapter having a tray for receipt and transport of water emerging from a said water nozzle disposed within said gas nozzle.

29. The apparatus of claim 1 including said gas nozzles sloping downwardly in a direction away from said path of strip travel.

30. A method for cooling a strip of material comprising providing cooling means having a plurality of elongated gas nozzles projecting generally in a direction generally perpendicular the path of travel of the strip and gas supply means for supplying cooling gas to said gas nozzles and establishing gas flow therethrough, providing elongated water nozzles disposed within said elongated gas nozzles for discharge of water therefrom, and passing strip by said cooling apparatus at a predetermined distance and simultaneously discharging gas through said elongated gas nozzles and water through said elongated water nozzles such that a cocurrent two-fluid stream emerges from said elongated gas nozzles and impinges upon said strip.

31. The method of claim 30 including discharging said water from said elongated water nozzles at a position axially inwardly of the discharge end of said elongated gas nozzles, whereby a cocurrent two-fluid stream may be formed prior to impingement on said strip.

32. The method of claim 31 including positioning said elongated water nozzles within said elongated gas nozzles in a generally coaxial manner with said water nozzles not contacting the interior surface of said gas nozzles, whereby a shroud of gas will surround the water as it emerges from said water nozzles within said gas nozzles.

33. The method of claim 31 including discharging said water from the outlet of said water nozzle at about 0 to 4 inches from the gas nozzle outlet.

34. The method of claim 32 including employing generally circular gas nozzles and generally circular water nozzles.

35. The method of claim 32 including establishing said gas nozzles in a plurality of columns with nozzles in one column in a staggered position with respect to gas nozzles of an adjacent said column.

36. The method of claim 35 including said gas and water emerging from said gas nozzles moving in a direction generally perpendicular to the path of travel of said strip.

37. The method of claim 31 including employing a first cooling unit having said elongated gas nozzles and elongated water nozzles on one side of said strip and a second cooling unit having said elongated gas nozzles and elongated water nozzles on the other side of said strip.

38. The method of claim 31 including discharging gas from said gas nozzles at a velocity of about 8,000 to 13,000 feet per minute.

39. The method of claim 38 including discharging water from said water nozzles at a rate of about 0.1 to 4.6 gallons per minute.

40. The method of claim 39 including establishing the internal diameter of said water nozzles is about ⅛ to 7/16 inch.

41. The method of claim 31 including delivering containment air to said strip at a position displaced along said strip from the positions at which said gas emerging from said gas nozzles and water emerging from said water nozzles impinge on said strip.

42. The method of claim 41 including employing a containment gas supply source which has an elongated slot to provide a transverse band of gas to said strip.

43. The method of claim 41 including moving said strip through said cooling zone and causing said water containment gas to impinge on said strip at a position spaced from the position of impingement of the gas from said gas nozzles and water from said water nozzles and thereby resisting undesired flow of said water along said strip.

44. The method of claim 30 including employing said method to cool galvanized metal strip.

45. The method of claim 30 including positioning the outlet ends of said gas nozzles about 6 to 12 inches from said strip.

46. The method of claim 43 including delivering said water containment gas from said slot at a velocity of about 200 to 250 feet per second.

47. The method of claim 44 including effecting during said cooling a reduction in strip temperature from about 1,000° F. or more to about 350° F. or less.

48. The method of claim 30 including during said cooling operating same said gas nozzles without water flow in the water nozzles contained therein.

49. The method of claim 30 including reducing water flow to said strip when gas flow is interrupted or terminated.

50. The method of claim 30 including altering the cooling of said strip by altering at least one of the gas flow rate and the water flow rate.

51. The method of claim 30 including effecting said cooling on metal strip.

52. The method of claim 51 including effecting said cooling while said strip is moving about 250 to 600 feet per minute.

* * * * *